US009446888B2

(12) United States Patent
Mussio

(10) Patent No.: US 9,446,888 B2
(45) Date of Patent: Sep. 20, 2016

(54) MULTI-COMPARTMENTED FLOWABLE-FOODSTUFF STORAGE CONTAINER PLUS DISPENSER AND RELATED METHODS

(71) Applicant: Abraham Mussio, Houston, TX (US)

(72) Inventor: Abraham Mussio, Houston, TX (US)

( * ) Notice: Subject to any disclaimer, the term of this patent is extended or adjusted under 35 U.S.C. 154(b) by 50 days.

(21) Appl. No.: 14/521,304

(22) Filed: Oct. 22, 2014

(65) Prior Publication Data

US 2016/0114942 A1 Apr. 28, 2016

(51) Int. Cl.

| | |
|---|---|
| ***B67D 7/78*** | (2010.01) |
| ***B65D 47/08*** | (2006.01) |
| ***B65D 25/28*** | (2006.01) |
| ***B65D 43/02*** | (2006.01) |
| ***B65D 1/24*** | (2006.01) |
| ***B65D 51/18*** | (2006.01) |
| ***B65D 83/06*** | (2006.01) |
| ***A47G 19/12*** | (2006.01) |

(52) U.S. Cl.

CPC ..... *B65D 47/0895* (2013.01); *A47G 19/12* (2013.01); *B65D 1/24* (2013.01); *B65D 25/2897* (2013.01); *B65D 43/0202* (2013.01); *B65D 51/18* (2013.01); *B65D 83/06* (2013.01); *A47G 2019/122* (2013.01); *B65D 2251/009* (2013.01); *B65D 2251/0025* (2013.01); *B65D 2251/0028* (2013.01); *B65D 2251/0081* (2013.01); *B65D 2543/00074* (2013.01)

(58) Field of Classification Search

CPC ..... A47G 2019/122; A47G 19/12; B65D 83/0445; B65D 51/18; B65D 47/0895; B65D 25/2897; B65D 43/0202; B65D 1/24; B65D 83/06; B65D 2543/00074; B65D 2251/0025; B65D 2251/0028; B65D 2251/0081; B65S 1/36

USPC ..... 222/145.1, 129, 142.7, 142.1, 142.2, 222/575; 220/523–526, 254.1–254.4; 215/6

See application file for complete search history.

(56) References Cited

U.S. PATENT DOCUMENTS

| | | | | |
|---|---|---|---|---|
| 2,469,034 | A | 5/1949 | Garris | |
| 2,903,127 | A | 9/1959 | Dorman | |
| 3,358,818 | A | 12/1967 | Davis | |
| 4,488,667 | A * | 12/1984 | Swett | A47G 19/24 222/142.2 |
| 4,693,399 | A | 9/1987 | Hickman et al. | |
| 4,955,503 | A | 9/1990 | Propes | |
| 5,316,159 | A | 5/1994 | Douglas et al. | |
| 5,706,981 | A * | 1/1998 | Nobakht | B65D 47/0804 222/132 |
| 5,753,289 | A | 5/1998 | Ness | |
| 5,921,440 | A | 7/1999 | Maines | |
| 5,954,213 | A | 9/1999 | Gerhart et al. | |
| 6,079,586 | A | 6/2000 | Hanneman | |
| 6,758,411 | B2 | 7/2004 | Conway et al. | |
| 7,021,481 | B2 | 4/2006 | Germain et al. | |
| 7,806,298 | B2 | 10/2010 | Kraus et al. | |
| 7,975,868 | B1 * | 7/2011 | Flies | B65D 1/24 215/12.1 |
| 8,152,020 | B2 | 4/2012 | Flowers et al. | |
| 8,616,390 | B2 | 12/2013 | Kountotsis | |
| 8,651,271 | B1 | 2/2014 | Shen | |
| 2006/0032776 | A1 | 2/2006 | Klein et al. | |
| 2008/0128427 | A1 | 6/2008 | Friedman | |
| 2009/0090723 | A1 | 4/2009 | Holbrook et al. | |
| 2012/0199546 | A1 | 8/2012 | Dieni | |
| 2012/0279990 | A1 * | 11/2012 | Werner | B05B 11/3083 222/132 |
| 2013/0001233 | A1 | 1/2013 | Hylton | |
| 2015/0102041 | A1 * | 4/2015 | Lee | A47G 19/30 220/575 |

* cited by examiner

*Primary Examiner* — Lien Ngo

(74) *Attorney, Agent, or Firm* — Buche & Associates, P.C.; John K. Buche; Bryce A. Johnson

(57) ABSTRACT

Disclosed is a multi-compartmented storage container for storing two or more flowable materials in separate compartments so that the materials may be poured from the container individually or combined.

13 Claims, 5 Drawing Sheets

MULTI-COMPARTMENTED FLOWABLE-FOODSTUFF STORAGE CONTAINER PLUS DISPENSER AND RELATED METHODS

CROSS-REFERENCE TO RELATED APPLICATIONS

Not applicable.

STATEMENT REGARDING FEDERALLY SPONSORED RESEARCH OR DEVELOPMENT

Not applicable.

BACKGROUND OF THE INVENTION

1. Field of Invention

The subject matter of this written description is in the field of flowable foodstuff storage containers and dispensers. In particular, the subject matter of this specification is in the field of multi-compartmented storage containers plus dispensers for liquid foodstuffs, granular foodstuffs or foodstuffs defined by aggregated loose-solids (or semi-solids).

2. Description of Related Art

Flowable materials (e.g., materials that are liquid, granular or aggregated loose solids (or semi-solids)) are common and the need for storing and dispensing them is known in the art. That is to say, many containers exist for storing and dispensing flowable materials. The most basic container for storing and dispensing flowable materials is a single compartmented vessel, like a cup or bucket, defined by a vertical cylinder or a truncated cone with a flat bottom. Dispensing flowable material in a basic container can be accomplished via scooping a portion of the contents from the container or by pouring a portion of the contents over the rim of the container.

Problems sometimes arise when using basic containers for storing and dispensing flowable materials. First, accurately aiming the pour is difficult because pouring contents over the rim of a basic container is unfocused. This problem has been overcome via the addition of a spout to the rim of a container. Second, the contents of a basic container cannot be kept unattended for long periods of time without spoiling. This problem can sometimes be delayed or avoided by using a lid. Finally, a basic container cannot hold two different materials without at least partially mixing the two materials. This means that two basic containers are necessary to store and dispense two different materials. Some have overcome this problem via containers with multiple compartments (also known as "multi-compartmented containers") that each may contain a different material.

Multi-compartmented containers and dispensers are particularly useful for containing multiple materials that are frequently used together because the container keeps the materials proximate to one another. Examples of such containers include: U.S. Pub. Pat. No. 2013/0001233 and U.S. Pat. No. 4,955,503, which disclose multiple chamber fluid containers with side-by-side compartments for holding two fluids, e.g., a cold fluid and a hot fluid, that can be dispensed one at a time from separate sides of the container; U.S. Pat. No. 6,913,777 and U.S. Pub. Pat. No. 2002/0110622, which disclose multi-compartmented bottles for simultaneously dispensing cold cereal and milk; U.S. Pat. No. 5,921,440, which discloses a multi-compartmented condiment bottle for simultaneously dispensing two condiments, e.g., ketchup and mustard; and U.S. Pat. No. 5,588,550, which discloses a pressurized, multi-compartmented container which allows access to one compartment while blocking access to the remaining compartments. Although useful for containing materials in close proximity to one another, known multi-compartmented containers are not always satisfactory in every circumstance. For instance, known multi-compartmented containers are configured for dispensing either (a) one material at a time or (b) all materials at once, but not both.

SUMMARY OF THE INVENTION

In view of the foregoing, it is an objective of this application to describe a multi-compartmented storage container for storing two or more flowable materials in separate compartments so that the materials may be poured from the container individually or combined in a novel manner. In a preferred embodiment, the container is defined by a container with two compartments that are closable via a lid, wherein the lid features an electively closable opening for one compartment, an electively closable opening for the other compartment, and an electively closable opening for both compartments at once. In one embodiment, the container is generally an ovular cylinder with side-by-side compartments, but in another embodiment, the container may feature a squared cylinder instead of an ovular cylinder so that the opening of the lid may be enlarged. In one mode of operation, at least one of the openings is electively opened and the container leaned toward the opening so that materials may be poured from the open opening(s) to which the lean is directed. In one embodiment, the openings are electively closable via caps and the caps are configured to interact with a bump stop to prevent the caps from closing the openings when acted on by gravity while the container is leaned for dispensing.

Other objectives and desires may become apparent to one of skill in the art after reading the below disclosure and viewing the associated figures.

BRIEF DESCRIPTION OF THE FIGURES

The manner in which these objectives and other desirable characteristics can be obtained is explained in the following description and attached figures in which.

It is to be noted, however, that the appended figures illustrate only typical embodiments of the disclosed assemblies, and therefore, are not to be considered limiting of their scope, for the disclosed assemblies may admit to other equally effective embodiments that will be appreciated by those reasonably skilled in the relevant arts. Also, figures are not necessarily made to scale.

DETAILED DESCRIPTION OF PREFERRED EMBODIMENTS

In general, disclosed is a multi-compartmented storage container for storing two or more flowable materials in separate compartments so that the materials may be poured from the container individually or combined. In a preferred embodiment, the container is defined by a container with two compartments that are closable via a lid, wherein the lid features an electively closable opening for one compartment, an electively closable opening for the other compartment, and an electively closable opening for both compartments at once. In one mode of operation, at least one of the openings is electively opened and the container leaned to one side or the other so that materials may be poured from the open opening(s). The more specific details of the disclosed container may be made with reference to the drawings.

Figure 1:
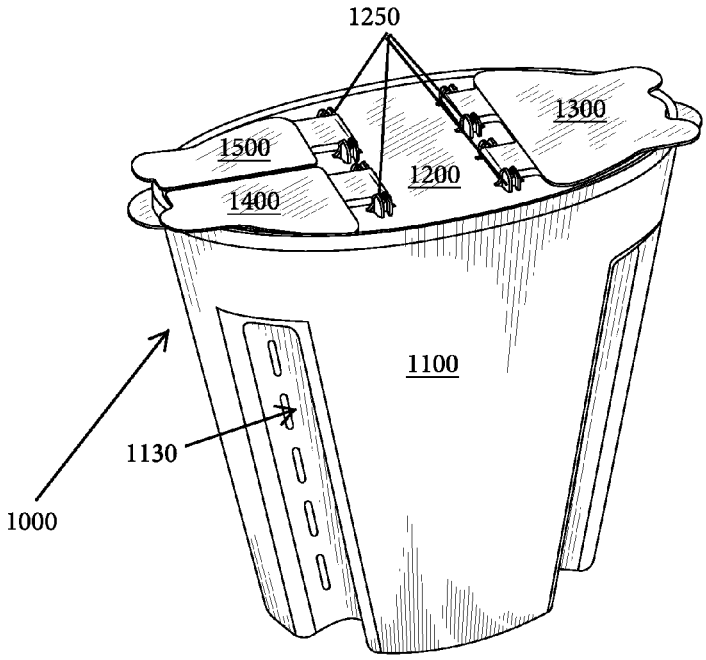
FIG. 1 is a perspective view of a multi-compartmented container.
Figure 2:
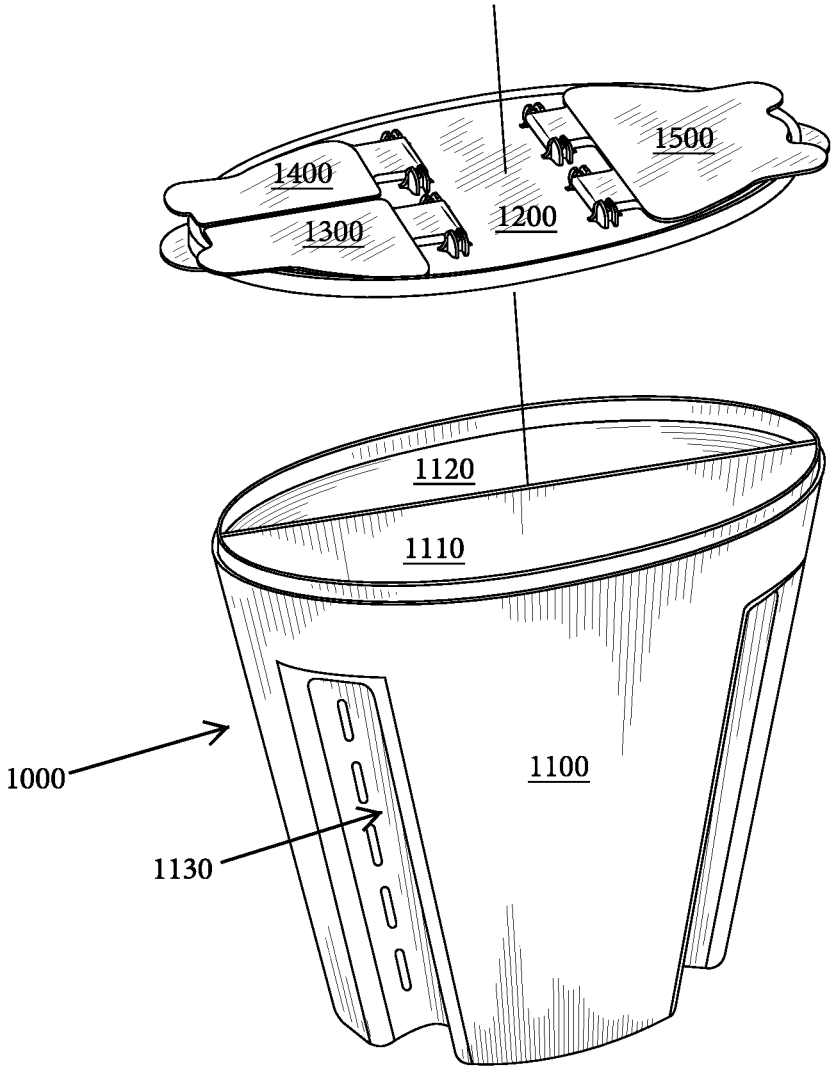
FIG. 2 is an exploded view of the container of FIG. 1.
Figure 3:
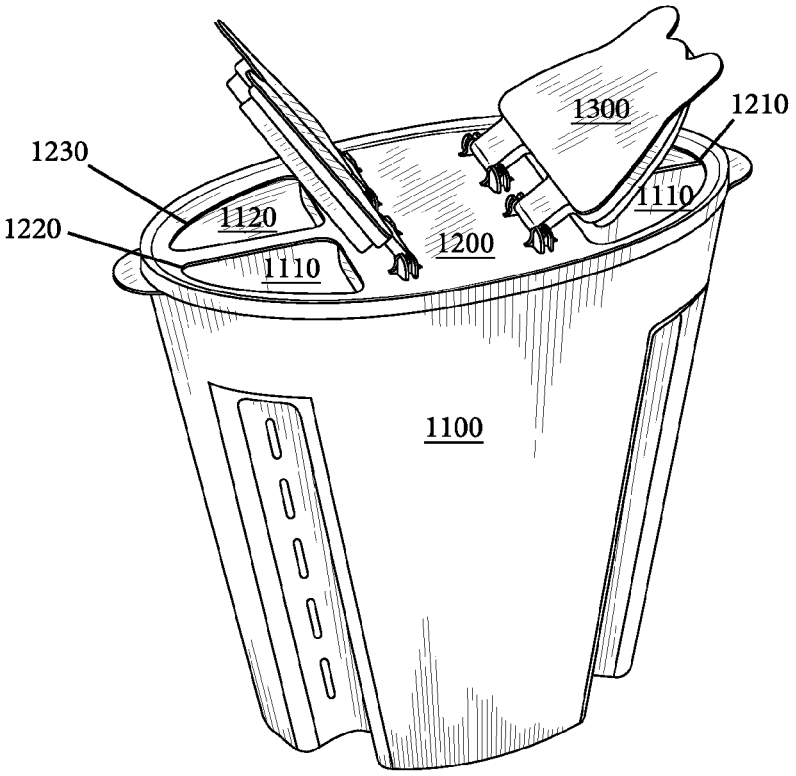
FIG. 3 is a perspective view of the container of FIG. 1 in an alternate configuration.
Figure 3A:
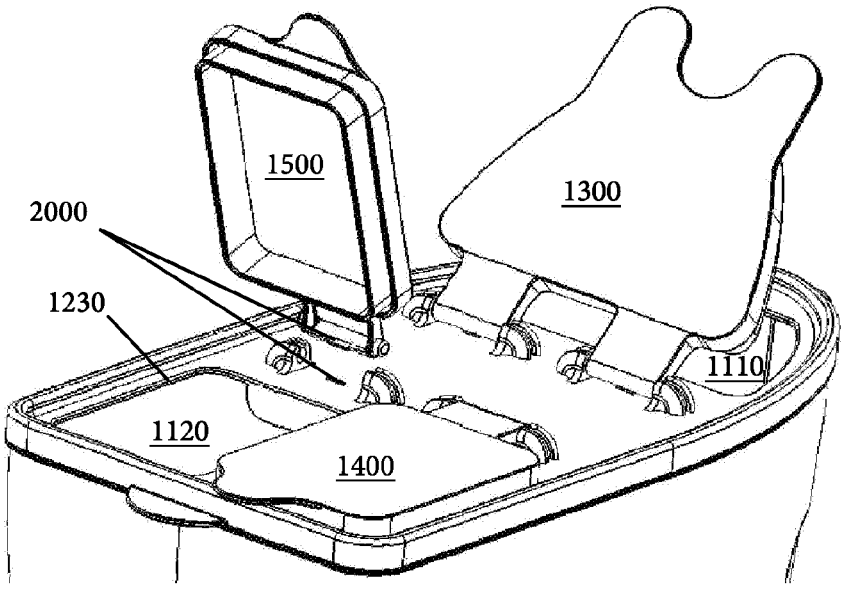
FIG. 3A is a perspective view of the container of FIG. 1A in an alternate configuration.

FIG. 1 is a perspective view of a multi-compartmented container 1000. FIG. 2 is an exploded view of the container 1000 of FIG. 1. FIG. 3 is a perspective view of the multi-compartmented container of FIGS. 1 and 2 in an alternate configuration. As shown in FIGS. 1 and 2, the container 1000 preferably comprises: a body 1100; a lid 1200; and caps 1300, 1400, 1500. Suitably, the lid 1200 may be removably positioned over the body as shown in FIG. 2. In a preferred embodiment, the lid 1200 suitably features a plastic or rubber lining around its perimeter to ensure a secure or air tight fit with the body 1100. The caps 1300, 1400, 1500 may be hinged away from the lid 1200 as shown in FIGS. 3 and 3A.

Referring to FIGS. 1 and 2, the body 1100 is defined generally by an ovular cylinder with side-by-side compartments 1110, 1120. Suitably, the compartments 1110, 1120 are separated by a wall that divides the cylinder into two sections. In a preferred embodiment, the compartments 1110, 1120 are configured to be filled with dry foods, e.g., cold cereals. That said, the compartments 1110, 1120 may also be filled with other flowable materials and food stuffs like milk. Although predominantly ovular and cylindrical, the body 1100 suitably may feature indentations 1130 on its sides that define grips. As shown in the drawings, the indentations 1130 extend from the base of the body 1100 to more than half the distance to the top of the body 1100. In a preferred embodiment, the indentations extend from the base of the body 1100 to approximately an inch from the top of the body 1110. Preferably, the indentations 1130 are deep enough to accommodate average human fingers when the hand is wrapped around the container with the fingers in one side of the container 1000 and the thumb on the other side of the container 1000.

Referring to FIGS. 1, 2 and 3, the lid 1200 may suitably feature three openings 1210, 1220, 1230 (FIG. 3) that are electively closable by hinged caps 1300, 1400, 1500. The caps 1300, 1400, 1500 are hingedly attached to the lid 1200 via hinges 1250. In FIGS. 1 and 2, the openings 1210, 1220, 1230 cannot be seen because the caps 1300, 1400, 1500 are depicted in a closed position. Referring to FIGS. 2 and 3, the lid 1200 is generally defined by an ovular disk (best seen in FIG. 2). On one side of the lid 1200, a single large opening 1210 (FIG. 3) under cap 1300 spans the width of the lid 1200. When the cap 1300 is in an open configuration (FIG. 3), the compartments 1110, 1120 of the body 1100 are exposed at opening 1210. On the opposite side of the lid 1200, two smaller openings 1220, 1230 (FIG. 3) that are under caps 1400, 1500 span half way across the lid 1200. When cap 1400 is open, the compartment 1110 is exposed at the opening 1220; when the cap 1500 is open, the compartment 1120 is exposed at opening 1230. Each of the caps 1300, 1400, 1500 operate by a basic hinge mechanism with the hinges 1250. The caps 1300, 1400, 1500 effectively cover or close the opening when in a closed positions (FIG. 1) and the openings 1210, 1220, 1230 can be opened or uncovered via pivoting the caps 1300, 1400, 1500 relative to the lid 1200.

Figure 4:
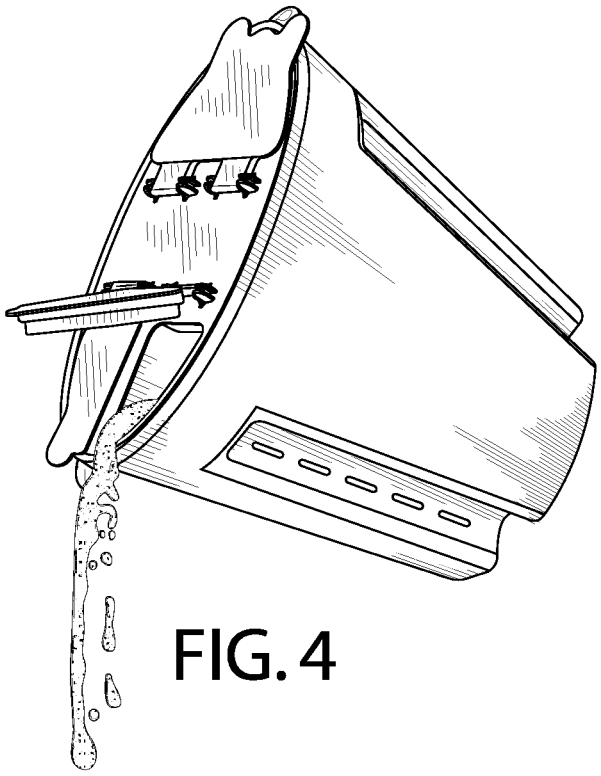
FIG. 4 is an environmental view of the container of FIG. 1.
Figure 5:
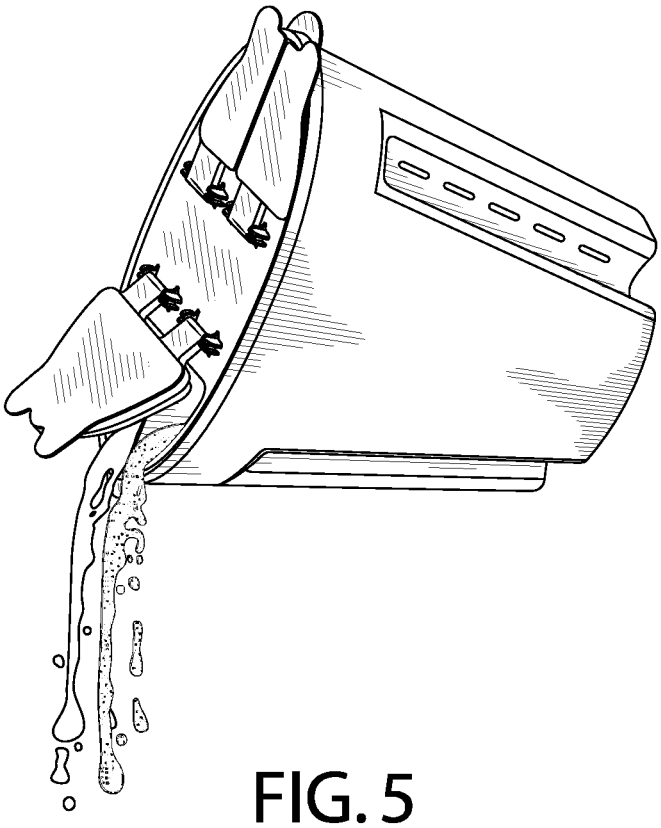
FIG. 5 is another environmental view of the container of FIG. 1.

FIG. 4 is an environmental view of the container 1000 of FIGS. 1 through 3. FIG. 5 is another environmental view of the container 1000 of FIGS. 1 through 3. As shown in the figure, the compartments 1110, 1120 may be electively exposed by manipulating the configuration of the caps 1300, 1400, 1500. When the compartments 1110, 1120 are exposed, the container 1000 may be tipped toward the open openings to pour contents from the exposed compartments. FIG. 4 shows contents being poured from both compartments while FIG. 5 shows contents being poured from one compartment.

Figure 1A:
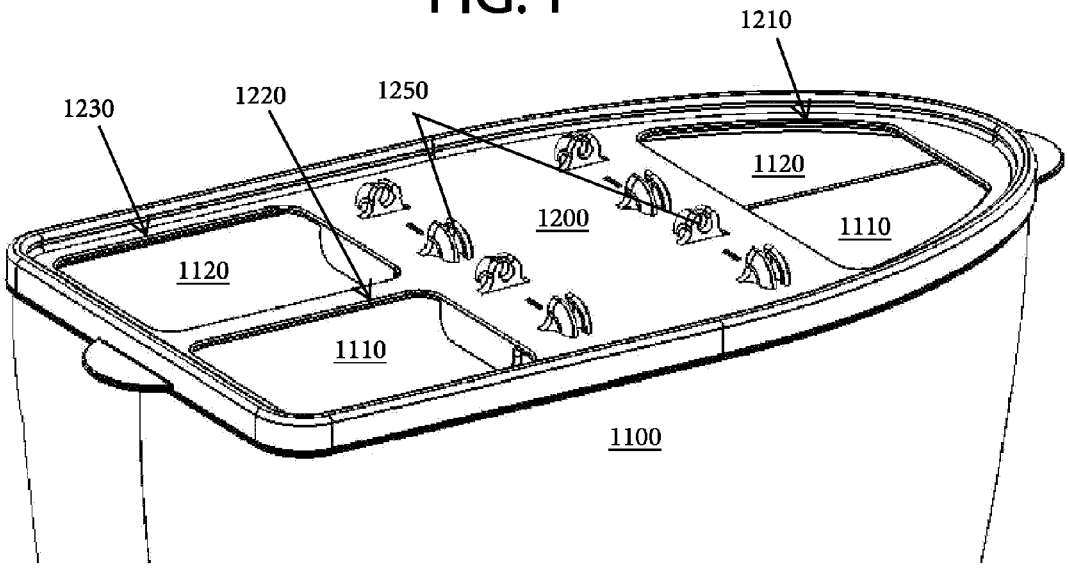
FIG. 1A is a zoomed-in perspective of an alternate embodiment of a multi-compartmented container.
Figure 2A:
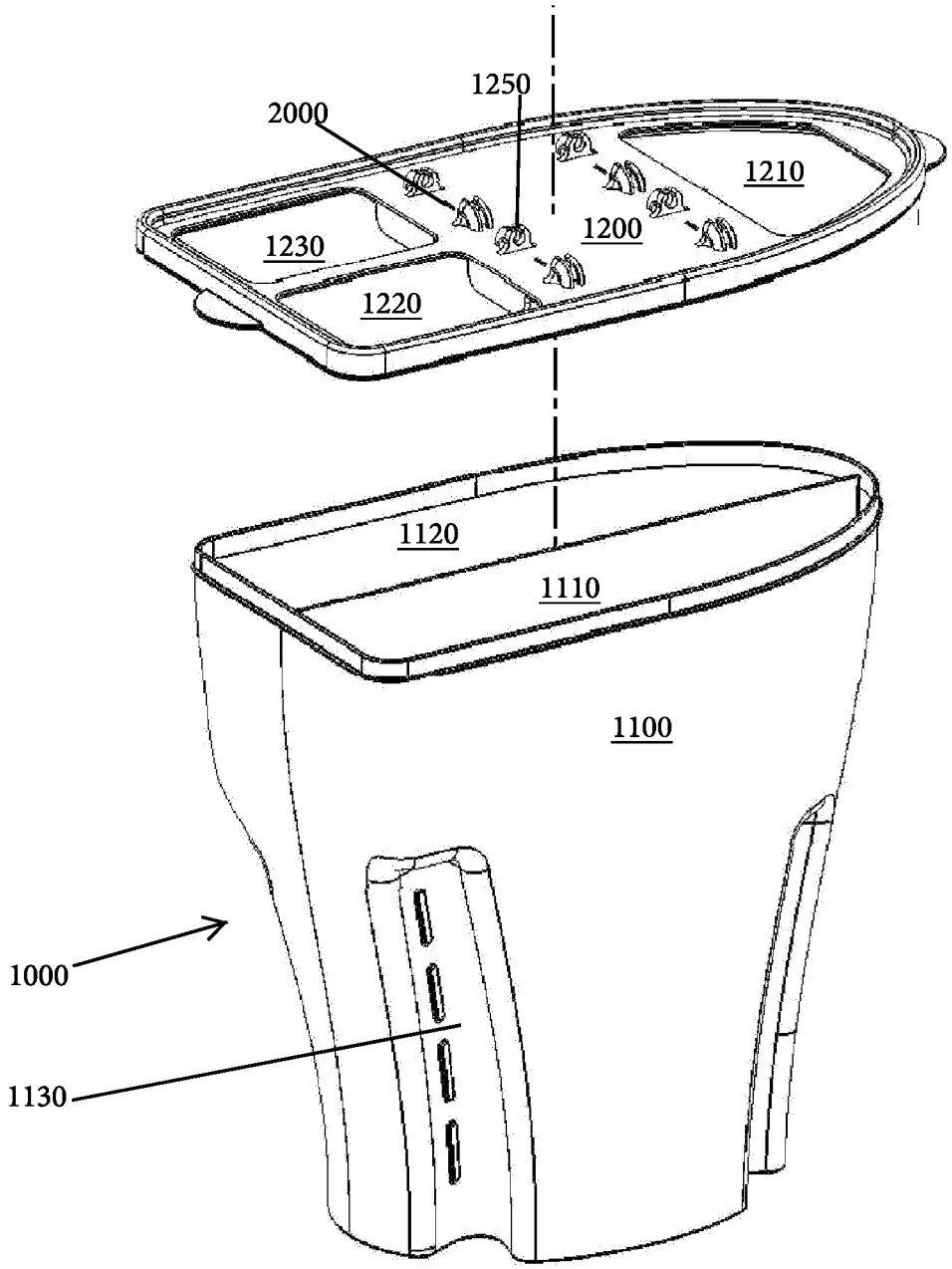
FIG. 2A is an exploded view of the container of FIG. 1A.

FIG. 1A is a perspective view of an alternate embodiment of a multi-compartmented container 1000. FIG. 2A is an exploded view of the container 1000 of FIG. 1A. FIG. 3A is a perspective view of the multi-compartmented container of FIGS. 1A and 2A with caps attached. The embodiment of FIGS. 1A through 3A is essentially the same as the embodiment shown in FIGS. 1 through 3 except the body is shaped differently. Also, in FIGS. 1A and 2A, the caps 1300, 1400, 1500 have been removed and are not shown until FIG. 3A while the caps 1300, 1400, 1500 of FIGS. 1 through 3 are shown throughout all of those drawings.

As shown in FIGS. 1A and 2A, the new embodiment of the container 1000 preferably comprises: a body 1100; a lid 1200; and caps 1300, 1400, 1500 (FIG. 3). Suitably, the lid 1200 may be removably positioned over the body as shown in FIG. 2A in an air-tight manner. Finally, the caps 1300, 1400, 1500 may be hinged away from the lid 1200 as shown in FIG. 3A.

Referring to FIGS. 1A and 2A, the body 1100 is defined generally by a squared ovular cylinder with side-by-side compartments 1110, 1120. Suitably, the compartments 1110, 1120 are separated by a wall that divides the cylinder into two sections. In a preferred embodiment, the compartments 1110, 1120 are configured to be filled with dry foods, e.g., cold cereals. That said, the compartments 1110, 1120 may also be filled with other flowable materials and food stuffs. Suitably, the body 1100 may feature indentations 1130 on its sides that define a grip. As shown in the drawings, the indentations 1130 extend from the base of the body 1100 to more than half the distance to the top of the body 1100. In a preferred embodiment, the indentations extend from the base of the body 1100 to approximately an inch from the top of the body 1110. Preferably, the indentations 1130 are deep enough to accommodate average human fingers when the hand is wrapped around the container with the fingers in one side of the container 1000 and the thumb on the other side of the container 1000.

Referring to FIGS. 1A, 2A and 3A, the lid 1200 may suitably feature three openings 1210, 1220, 1230 that are electively closable by hinged caps 1300, 1400, 1500 (FIG. 3A). The caps 1300, 1400, 1500 (FIG. 3A) are hingedly attached to the lid 1200 via hinges 1250. In FIGS. 1A and 2A, the openings 1210, 1220, 1230 can be seen because the caps 1300, 1400, 1500 (FIG. 3A) are not shown. Referring to FIGS. 2A and 3A, the lid 1200 is generally defined by a squared ovular disk (best seen in FIG. 2). On one side of the lid 1200, a single large opening 1210 under cap 1300 (FIG. 3A) spans the width of the lid 1200. When the cap 1300

(FIG. 3A) is in an open configuration, compartments 1110 and 1120 of the body 1100 are exposed at opening 1210. On the opposite side of the lid 1200, two smaller openings 1220, 1230 that are under caps 1400, 1500 (FIG. 3A) span half way across the lid 1200. When cap 1400 is open, the compartment 1110 is exposed at the opening 1220; when the cap 1500 is open, the compartment 1120 is exposed at opening 1230. Each of the caps 1300, 1400, 1500 operates by a basic hinge mechanism with the hinges 1250. The caps 1300, 1400, 1500 (FIG. 3) effectively cover or close the opening when in a closed position and the openings 1210, 1220, 1230 can be opened or uncovered via pivoting the caps 1300, 1400, 1500 relative to the lid 1200. In a preferred embodiment, the lid 1200 and caps 1300, 1400, 1500 are configured with cooperating bump stops 2000 to combat gravity when the container 1000 is tilted for pouring contents (i.e., the bump stops 2000 operate to keep the caps 1300, 1400, 1500 open).

Suitably, a container 1000 may be used in the following ways: (1) the compartments 1110, 1120 may be configured to hold the contents of a standard cereal box and filed with cold cereal; (2) the lid 1200 may be positioned over compartments 1110, 1120; (3) pivoting one or more of the caps 1300, 1400, 1500 from their openings; (4) tiling the container 1000 toward the open caps.

Example 1

A user enjoys mixing raisin bran cereal with frosted cereal for breakfast, but usually is in a hurry in the morning. The user can store raisin bran in one side of the container and frosted cereal in the other side of the container. In the morning the user can save time by grabbing the container, instead of separate containers for raisin bran and frosted cereal. The user can pour the raisin bran and frosted cereal into a bowl separately, as demonstrated in FIG. 4, or to save even more time, the user can pour both out at once, as demonstrated by FIG. 5.

Example 2

A user is hosting a party. The user wishes to serve cocktails to the guests. However, the user knows that some of the guests will be designated drivers, and will not want to drink alcohol. The user can put a non-alcoholic mixer, such as cranberry juice, in one side of the container, and a distilled liquor, such as vodka, in the other half of the container. The user can pour a mixed drink from the larger opening, as shown in FIG. 5, or pour a non-alcoholic drink from one of the smaller openings, as show in FIG. 4.

Other features will be understood with reference to the drawings. While various embodiments of the method and apparatus have been described above, it should be understood that they have been presented by way of example only, and not of limitation. Likewise, the various diagrams might depict an example of an architectural or other configuration for the disclosed method and apparatus, which is done to aid in understanding the features and functionality that night be included in the method and apparatus. The disclosed method and apparatus is not restricted to the illustrated example architectures or configurations, but the desired features might be implemented using a variety of alternative architectures and configurations. Indeed, it will be apparent to one of skill in the art how alternative functional, logical, or physical partitioning and configurations might be implemented to implement the desired features of the disclosed method and apparatus. Also, a multitude of different constituent module names other than those depicted herein might be applied to the various partitions. Additionally, with regard to flow diagrams, operational descriptions and method claims, the order in which the steps are presented herein shall not mandate that various embodiments be implemented to perform the recited functionality in the same order unless the context dictates otherwise.

Although the method and apparatus is described above in terms of to various exemplary embodiments and implementations, it should be understood that the various features, aspects, and functionality described in one or more of the individual embodiments are not limited in their applicability to the particular embodiment with which they are described, but instead might be applied, alone or in various combinations, to one or more of the other embodiments of the disclosed method and apparatus, whether or not such embodiments are described and whether or not such features are presented as being a part of a described embodiment. Thus the breadth and scope of the claimed invention should not be limited by any of the above-described embodiments.

Terms and phrases used in this document, and variations thereof, unless otherwise expressly stated, should be construed as open-ended as opposed to limiting. As examples of the foregoing: the term "including" should be read as meaning "including, without limitation" or the like, the term "example" is used to provide exemplary instances of the item in discussion, not an exhaustive or limiting list thereof, the terms "a" or "an" should be read as meaning "at least one," "one or more," or the like, and adjectives such as "conventional," "traditional," "normal," "standard," "known" and terms of similar meaning should not be construed as limiting to the item described to a given time period or to an item available as of a given time, but instead should be read to encompass conventional, traditional, normal, or standard technologies that might be available or known now or at any time in the future. Likewise, where this document refers to technologies that would be apparent or known to one of ordinary skill in the art, such technologies encompass those apparent or known to the skilled artisan now or at any time in the future.

The presence of broadening words and phrases such as "one or more," "at least," "but not limited to" or other like phrases in some instances shall not be read to mean that the narrower case is intended or required in instances where such broadening phrases might be absent. The use of the term "module" does not imply that the components or functionality described or claimed as part of the module are all configured in a common package. Indeed, any or all of the various components of a module, whether control logic or other components, might be combined in a single package or separately maintained and might further be distributed across multiple locations.

Additionally, the various embodiments set forth herein are described in terms of exemplary block diagrams, flow charts, and other illustrations. As will become apparent to one of ordinary skill in the art after reading this document, the illustrated embodiments and their various alternatives might be implemented without confinement to the illustrated examples. For example, block diagrams and their accompanying description should not be construed as mandating a particular architecture or configuration.

The claims, as originally filed, are hereby incorporated into the specification by reference.

I claim:

1. A multi-compartmented storage container for storing two or more flowable materials in separate compartments so that the materials may be poured from the container individually or combined comprising:

a body with a cavity and wall for dividing the cavity into two compartments;

a lid with three openings;

and caps for electively closing the three openings of the lid;

wherein the lid may be removably positioned over the body so that at least one opening exposes only one of the compartments and so that another one of the openings exposes both of the compartments.

2. The container of claim 1 further comprising indentations in the body for assisting a user in gripping of the body.

3. The container of claim 2 wherein the grips further feature indentations for assisting with the gripping of the body.

4. The container of claim 1 wherein each compartment is voluminous enough to contain at least a standard box of cold cereal.

5. The container of claim 1 wherein the body is configured for upright placement on a flat surface.

6. The container of claim 1 wherein the caps are configured to hinge relative to the openings and wherein the lid and caps feature bump stops to prevent hinging by gravity alone.

7. The container of claim 1 wherein the lid is positioned over the body in a substantially airtight manner.

8. The container of claim 7 wherein the caps form an airtight seal with the lid when positioned over the openings.

9. The container of claim 1 wherein the body, lid, and caps are constructed of food safe plastic.

10. The container of claim 9 wherein the body, lid, and caps are constructed of polypropylene.

11. A method of mixing flowable material comprising:

obtaining a multi-compartmented storage container where the container features a body with a cavity and wall for dividing the cavity into two compartments; a lid with three openings; and caps for electively closing the three openings of the lid;

wherein the lid may be removably positioned over the body so that at least one opening exposes only one of the compartments and so that another one of the openings is substantially bisected by the compartments;

filling the first compartment of the container with a flowable material;

filling the second compartment of the container with a flowable material;

pouring the contents of the container into a receptacle.

12. A method of mixing flowable material according to claim 11 further comprising pouring the contents of the first compartment out of the opening positioned over the first compartment into a receptacle;

pouring the contents of the second compartment out of the opening positioned over the first compartment into said receptacle.

13. A method of mixing flowable material according to claim 11 further comprising pouring the contents of the two compartments out of the opening that is substantially bisected by the two compartments.

* * * * *